US008459323B2

(12) United States Patent
Brendle

(10) Patent No.: US 8,459,323 B2
(45) Date of Patent: Jun. 11, 2013

(54) FLAT BED EMBOSSING MACHINE COMPRISING A FOIL WEB GUIDING DEVICE

(75) Inventor: Marc Günther Brendle, Goldach (CH)

(73) Assignee: Gietz AG, Gossau (CH)

( * ) Notice: Subject to any disclaimer, the term of this patent is extended or adjusted under 35 U.S.C. 154(b) by 292 days.

(21) Appl. No.: 12/991,682

(22) PCT Filed: May 25, 2009

(86) PCT No.: PCT/CH2009/000175

§ 371 (c)(1),
(2), (4) Date: Dec. 3, 2010

(87) PCT Pub. No.: WO2009/143644

PCT Pub. Date: Dec. 3, 2009

(65) Prior Publication Data

US 2011/0265671 A1 Nov. 3, 2011

(30) Foreign Application Priority Data

May 27, 2008 (CH) ..... 797/08

(51) Int. Cl.
*B32B 37/00* (2006.01)

(52) U.S. Cl.
USPC ..... 156/361; 156/459; 156/494

(58) Field of Classification Search
USPC ..... 156/350, 361, 378, 443, 459, 468, 156/475, 494, 581
See application file for complete search history.

(56) References Cited

U.S. PATENT DOCUMENTS

| | | | | |
|---|---|---|---|---|
| 4,336,813 | A | 6/1982 | Seragnoli | |
| 5,611,272 | A | 3/1997 | Steuer | |
| 5,979,308 | A * | 11/1999 | Kagi et al. | 101/3.1 |
| 6,425,323 | B1 | 7/2002 | Steuer | |
| 7,424,903 | B2 * | 9/2008 | Kagi et al. | 156/459 |
| 2005/0247406 | A1 | 11/2005 | Kagi et al. | |

FOREIGN PATENT DOCUMENTS

| | | | |
|---|---|---|---|
| CH | 683407 | A5 | 3/1994 |
| DE | 3037376 | A1 | 4/1981 |
| DE | 9420707 | U1 | 2/1995 |
| DE | 1593503 | A | 11/2005 |
| EP | 0989086 | A | 3/2000 |

OTHER PUBLICATIONS

International Search Report for international application No. PCT/CH09/00175 mailed Oct. 2, 2009.

* cited by examiner

*Primary Examiner* — James Sells
(74) *Attorney, Agent, or Firm* — Oppedahl Patent Law Firm LLC

(57) ABSTRACT

The flat bed embossing machine with a foil web guiding device (2) for a plurality of foil webs (6), which are conducted over a tool plate (3), for every foil web ahead of the tool plate comprises an individual, adjustable web guide (11.1, 11.2, 11.3) as foil tensioning devices. The web guides comprise suction openings (14), connected with controllable negative pressure sources (13.1, 13.2, 13.3) for the independent setting of negative pressure (pi) on each individual web guide. To every foil web (**6*i*) a print mark sensor (15*i*) and settable lateral guiding elements (30) on low-friction deflecting elements (31, 32) are assigned. So that every foil web (6*i***) can be optimally set for the print marks in drawing direction X and in transverse direction Y.

19 Claims, 7 Drawing Sheets

FLAT BED EMBOSSING MACHINE COMPRISING A FOIL WEB GUIDING DEVICE

The invention is related to an embossing machine with a foil web guiding device for several foil webs, which are guided from unwinding rolls over a tool plate of a flat bed press in accordance with the preamble (generic term) of claim 1. With embossing machines of this kind, such as, e.g., described in EP 0 858 888, it is possible to achieve particularly high embossing performances with the best quality and also demanding embossing tasks. These embossing machines on the other hand also make particularly high demands of the guiding and the precise drawing of the thin and very sensitive foil webs, with layer thicknesses of, e.g., solely 12-20 um (0.02 mm). In doing so, several foil webs of different types (with different web widths, advance drawing lengths and with differing peeling-off forces following the embossing operation) have to be guided and conveyed simultaneously perfectly smoothly. The web guiding has to take place without any warping, formation of folds and displacements, impeccably smoothly flat and correctly positioned. And the rapid, intermittent drawing advancing in a short time has to be carried out with optimum care, in order to be able to achieve high performance capacities and a high quality. An embossing machine and foil web guiding device of this kind is known, e.g., from EP 1 593 503. This foil web guiding device for the careful, better adjustment of the drawing tension in the foil webs comprises a wide, flat suction braking- and guiding wall ahead of the embossing table, wherein by means of an adjustable vacuum in the braking- and guiding wall it is possible to adjust the drawing tension of the foil webs running over it. This enables a foil web guide, which requires no contact with guiding elements on the sensitive embossing layer side (picture side) of the foil webs and it makes possible very good embossing qualities with dye foil webs.

With these known foil web guiding devices, however, for demanding picture embossing tasks, in particular for hologram embossing with picture security features, e.g., for bonds, identity cards or bank notes it is not possible to achieve over the whole embossing table for all foil webs an optimum, error-free positioning of the print marks and with this also of the embossed pictures. For this purpose, with the machine running every individual picture foil web would have to be capable of being separately optimally adjusted in the drawing direction X and in the transverse direction Y. This, however, is not possible with the known foil web guiding device according to EP 1 593 503.

It is therefore the objective of the present invention to create a better foil web guiding device for flat bed embossing machines with an optimum picture positioning in X- and Y-direction for all foil webs over the whole embossing position, which also enables the optimum adjustment of the foil web tensions in each individual picture foil web while the machine is running, this in particular for the embossing of holograms.

This objective is achieved in accordance with the invention by an embossing machine with a foil web guiding device with several, individually controllable web guides as foil web tensioning devices ahead of the tool plate in accordance with claim 1.

The dependent claims relate to advantageous further developments of the invention with further improvements of the foil web guiding and -positioning of the individual foil webs and with this also of the machine performance capacity and of the picture quality.

In the following the invention is explained in more detail on the basis of examples and Figures. These illustrate:

FIG. 1 a side view of an embossing machine in accordance with the invention with a foil web guiding device with several individual web guides, each with controllable negative pressure sources as foil tensioning devices for the individual picture foil webs, FIG. 2 an example of a foil web guiding device with web guides and function elements assigned to these, FIG. 3 a view from the front onto the individual symmetrical web guides, FIG. 4 a cross section through a web guide with suction channels with different zones for foil webs of differing width, FIG. 5 in cross section an example of a web guide with two zones, FIG. 6 a view from above onto the web guide of FIG. 5 with suction openings, FIG. 7 a further example of a web guide with suction openings, FIG. 8 an example with several individual web guides and picture foil webs, FIG. 9 an example with individual web guides for picture foil webs and an additional short braking- and guiding wall for dye foil webs, FIG. 10*a, b* adjustable lateral guiding elements assigned to the individual web guides, FIG. 11 an example of jointly adjustable lateral guiding elements, FIG. 12 a control of the temporal speed course of the foil drawing with increased adhesion during the embossing process, FIG. 13 an example with controllable negative pressure sources and vacuum switching valves.

FIGS. 1 and 2 illustrate a flat bed embossing machine 1 in accordance with the invention with a foil web guiding device 2 with several foil webs 6.1-6.4, which are guided from unwinding rolls 7.1-7.4 over a tool plate 3 with printing plates or dies 28 and a counter-pressure plate as embossing position 8 on a flat bed printing press 4. At the embossing position 8 foil pictures are embossed onto a flat material 5, 5.1, 5.2. The foil web guiding device for every foil web after the tool plate comprises foil drawing devices 9.1-9.4 and ahead of the tool plate 3 individual long and central symmetrical web guides 11.1-11.4 adjustable in transverse direction Y to the drawing direction X as foil tensioning devices. The individual web guides comprise suction channels 16, 17 and a smooth, low-friction surface 12 with suction openings 14, which are connected with controllable negative pressure sources 13.1-13.4 for the independent adjustment (setting) of negative pressure pi and braking force zfi on each individual web guide 11*i*. In doing so, assigned to every picture foil web 6*i* respectively are a print mark sensor 15*i* on the or between the foil drawing device 9*i* and the web guide 11*i* as well as adjustable (settable) lateral guiding elements 30 on both sides on low-friction deflecting elements 31, 32 directly ahead of the web guides 11*i* and after the tool plate 3, with which lateral guiding elements 30 the picture foil webs 6*i* are capable of being guided centrally on the web guides 11*i*. With this, each individual picture foil web with the machine running is capable of being optimally adjusted to the print marks in X- and in Y-direction and picture position errors are able to be minimised as a result of this.

The optimum adjustment and positioning of each picture foil web 6*i* in transverse direction Y takes place by adjustment of the lateral guiding elements 30 on low-friction deflecting elements 31, 32 directly ahead of the web guides 11*i* and after the embossing position 8. This centered guiding of the picture foil webs 6*i* on the correctly positioned, symmetrical long web guides 11*i* until close to the embossing position 8 prevents lateral deviations. The positioning of the picture foil webs in X-direction, i.e., the precise alignment of the print marks 27 by means of print mark sensors 15*i* in the error-free desired position is achieved by the controlling and adjusting of the negative pressure pi in the web guides 11*i*. An error-free positioning in X- and in Y-direction can only be achieved by independent adjustment of each individual foil web 6*i* while the machine is running.

The print mark sensors 15*i* are advantageously arranged on the foil drawing devices 9*i*, in the center of the tool plate 3 (on the printing plates) or at the end of the web guides 11*i*.

For embossing, all picture foil webs at the embossing position 8 have to comprise a certain optimum tensile stress z, which corresponds to a respective elongation (strain) ee of, e.g., ee=0.6%. This elongation over an embossing table length of, e.g., 100 cm results in a lengthening of the foil webs by 6 mm. The die plates 28 are positioned on the embossing plate taking into account this lengthening in case of an optimum elongation ee, resp., tensile stress z. If the tensile stresses zi (and with this the elongations eei) in the individual foil webs 6*i* deviate from the desired value, therefore correspondingly large picture position errors result. For an error-free picture positioning, therefore all foil webs 6*i* have to comprise the optimum tensile stress zi. The tensile stress zi for a foil web 6*i* is composed of the tensile stress zai ahead of the web guide plus the braking force, resp., tensile stress zfi, which is exerted by the web guide 11*i*: zi=zai+zfi. Because the tensile stresses ahead of the web guides 11*i* are very different, it is only possible to achieve the optimum value zi for all picture foil webs 6*i* by means of a corresponding controlling of the tensile stresses zfi on each individual web guide 11*i*.

The foil webs are guided to the web guides 11 from unwinding rolls 7 through a foil store 20 (FIG. 1). Utilised as foil stores advantageously are vacuum loop stores 20, in particular horizontal vacuum double-loop stores with negative pressure control, which are known, e.g., from EP 0 858 888. In the foil store 20 a first tensile stress za is exerted on the foil webs for the optimum guiding right up to the web guides 11. These tensile stresses za vary over time and are very different (zai) for different foil webs 6*i*, depending on the foil type and -width, on the loop length in the store and on the type of the intermittent advance drawing.

With the inventive foil web guiding device in accordance with FIG. 1 it is achieved, that over the whole length of the foil web guiding from the unwinding rolls 7 through the vacuum loop stores 20 and the web guides 11 up to the embossing position 8 no guiding elements are present on the image layer side 6*a* of the foil webs, i.e., that the sensitive image layer side 6*a* is nowhere contacted and subjected to wear.

A well dosable controlling of the braking force zfi on the web guides 11*i* and with this of the optimum tensile stress zi at the embossing position 8 is achieved by a smooth, low-friction, wear-resistant surface 12 with constant friction coefficients of the long web guides. For this purpose, the surfaces 12 in preference have to comprise a minimum electrical conductivity, so that no electro-static charging of the web guides 11 and of the foil webs 6 is able to take place.

It is possible, that suitable surfaces 12, for example, consist of a layer of fluoride polymer plastic material or of hard anodised aluminium with embedded fluoride polymer (e.g., PTFE), e.g., with a layer thickness of, e.g., 20-50 um. These comprise relatively low and constant friction coefficients of, e.g., 0.1-0.2.

In preference these surfaces 12 comprise as small as possible differences between static friction- and sliding friction coefficients of the foil webs of, e.g., at most 10-20% for the generation of continuous tensile stresses zfi.

FIG. 2 in more detail illustrates a further example of a guiding device 2 with four picture foil webs 6.1-6.4 and with negative pressure sources 13.1-13.4 assigned to them, which here are designed as controllable vacuum controllers 22.1-22.4 and are connected with a central suction fan 23. The suction fan generates a constant negative pressure (of, e.g., 20 kPa), which by the vacuum controllers is reduced to the required negative pressures pi on every web guide 11*i* (to, e.g., 5-10 kPa) for the generation of the optimum tensile stresses zfi with zi=zai+zfi in every picture foil web.

As a further advantageous embodiment it is possible that after the web guides 11*i* foil web tension sensors 40*i* are arranged for determining the foil tensions, with which the controlling of the negative pressure sources 13*i* is capable of being implemented as controlling to an adjustable set-point of the foil tensile stress zi, resp., the foil strain ee.

As illustrated in FIG. 2, the foil web guiding according to the invention can be utilised both in sheet embossing machines as well as in roll machines. The flat material 5 to be embossed in doing so comprises sheets 5.1, which are conducted from a feeder 71 to a delivery means 72 or which from continuous webs 5.2 in roll machines are conducted from an unwinding roll to a take-up roll (as, e.g., is described in EP 0 858 888).

FIG. 3 depicts a view from the front on to individual web guides 11.1-11.5, which comprise a width b and a length L (with L>b). The five picture foil webs 6.1-6.5 here comprise differing foil widths b1: The foil web 6.3 a relatively small foil web width b1.2 and the remaining foil webs a relatively large foil web width b.1.1. For the optimum foil web guiding and adjusting of the tensile stresses zfi, resp., zi, the adjustable and exchangeable symmetrical web guides 11*i* extend up to close to the embossing position 8 and are designed to be as long as possible with a length L of, e.g., 50-100 cm and with a ratio of length to width L/b within a range of between 5 and 15. The width b of the web guides amounts to, for example, 5 to 10 cm.

The FIGS. 4 and 5 in cross section illustrate examples of web guides with suction channels, which are particularly suitable for differing widths of foil webs b1. FIG. 4 shows a web guide with suction channels, which form a central zone with a suction channel 16 and two symmetrical edge zones with the suction channels 17.1 and 17.2. Corresponding to the foil web width b1, here only the zones covered by the foil web can be connected and evacuated with the negative pressure source 13*i*. In this manner it is possible to achieve a very uniform pressure distribution (pi).

FIG. 5 depicts an example of a web guide with a central suction channel 16 and with two, lateral suction channels 17 connected together, which through a leakage air control valve 18 are connected with the negative pressure source 13*i*. Not covered zones therefore here are not evacuated. A narrower foil web 6.2 with the width b1.2 covers the suction channel 16 and a wider foil web 6.1 with b1.1 also covers the suction channels 17.

FIG. 6 illustrates a view from above on to the web guide of FIG. 5 with few, relatively small suction openings 14 with a diameter of, e.g., 1-2 mm, which are arranged at large distances symmetrical to the central axis. In preference, the very small surface proportion of the suction openings, e.g., is within a range of 0.5-3%. This makes it possible to produce well adjustable, defined braking forces and tensile stresses zfi. The surface 12 with suction openings 14 can also consist to consist of a micro-porous layer permeable to air, for example, analogue to the air cushion supporting surface 37 of FIG. 10*a*, which, however, is sucked off instead of aerated.

Figure 9:
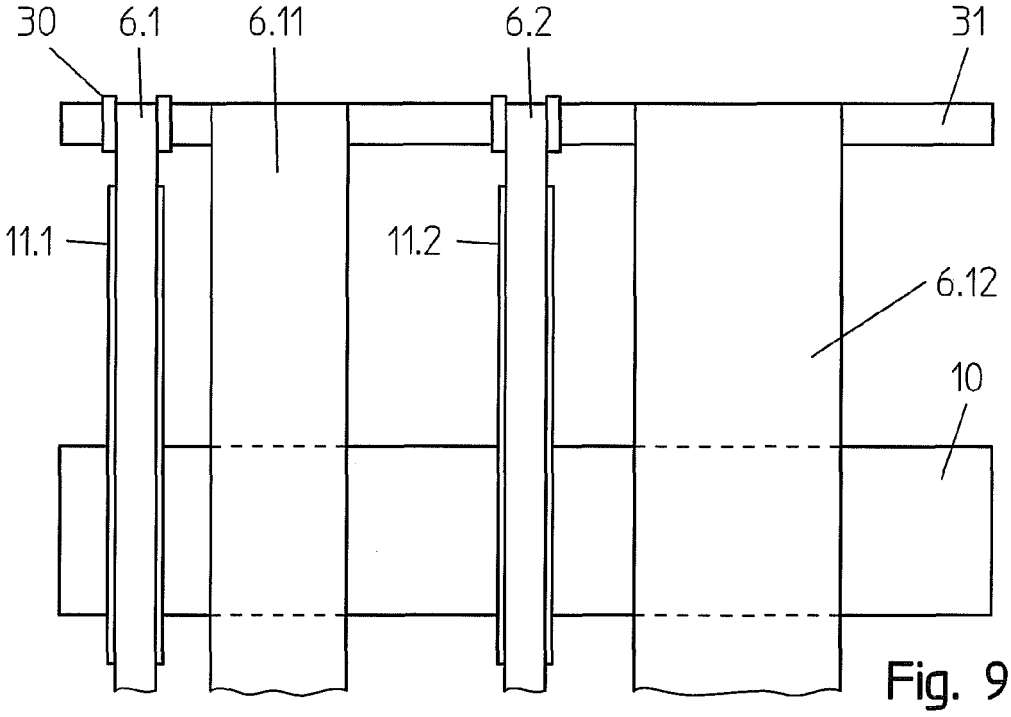

FIG. 9 illustrates an example of a foil web guiding, in the case of which picture foil webs 6.1, 6.2 are combined with dye foil webs 6.11, 6.12. In addition it is possible that under the interchangeable web guides 11*i* additionally a short and wide braking- and guiding wall 10 is arranged as foil tensioning device for the simultaneous embossing of dye foil webs 6.11, 6.12 and of several picture foil webs 6.1, 6.2. This enables a very broad application range of the embossing machine, from pure dye foil web embossing up to pure picture foil web embossing.

Figure 1:
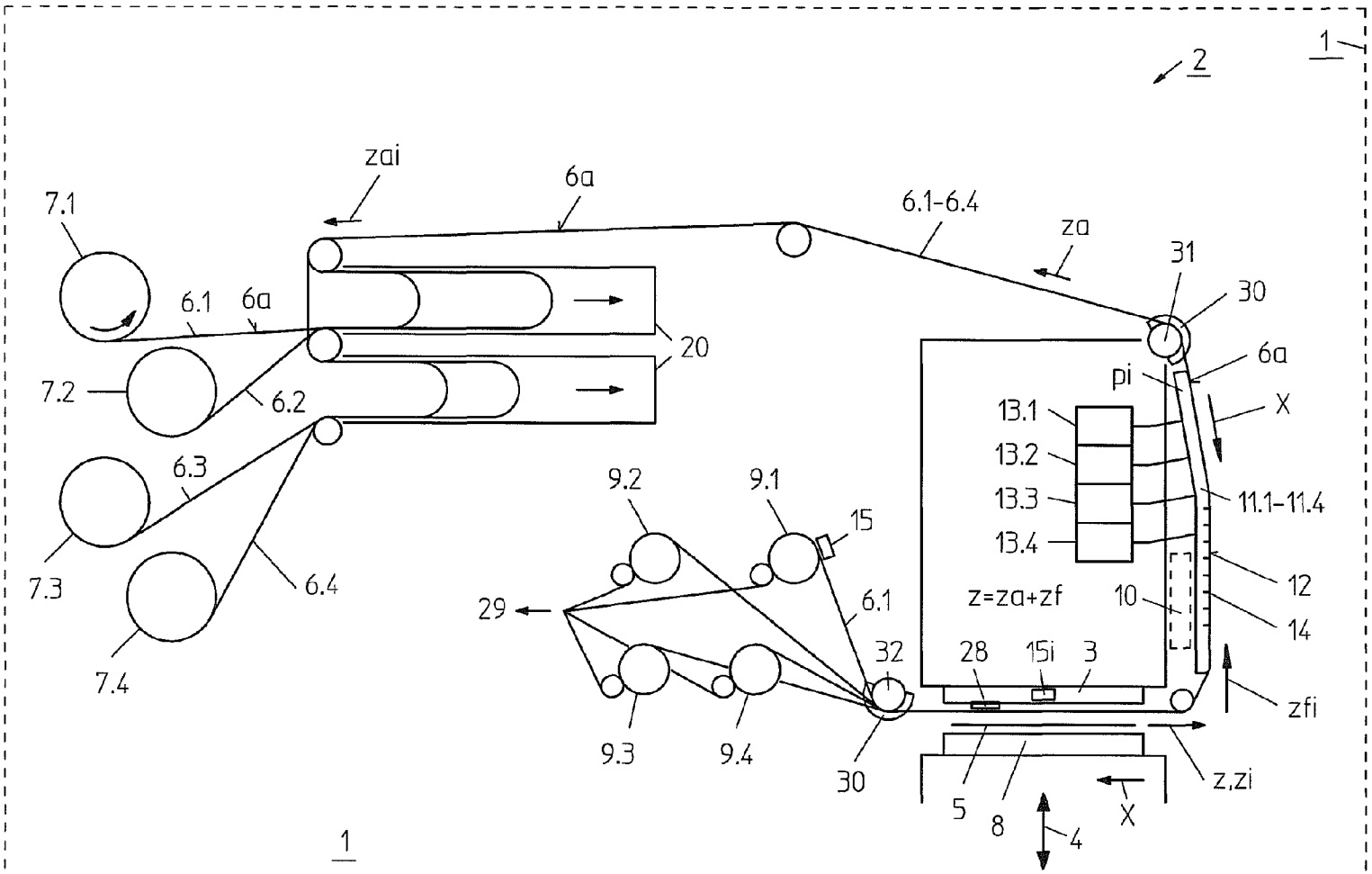
Figure 2:
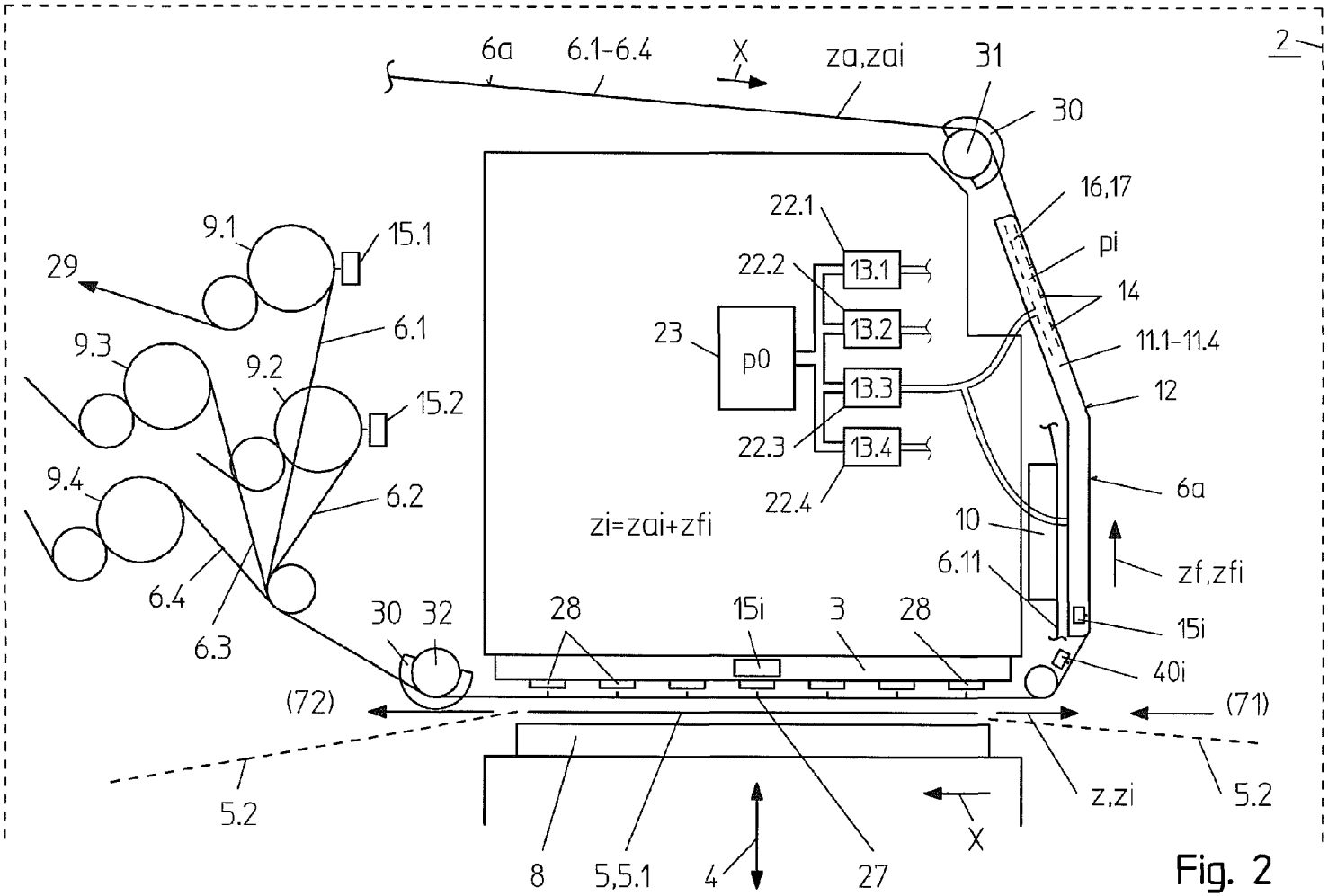
Figure 3:
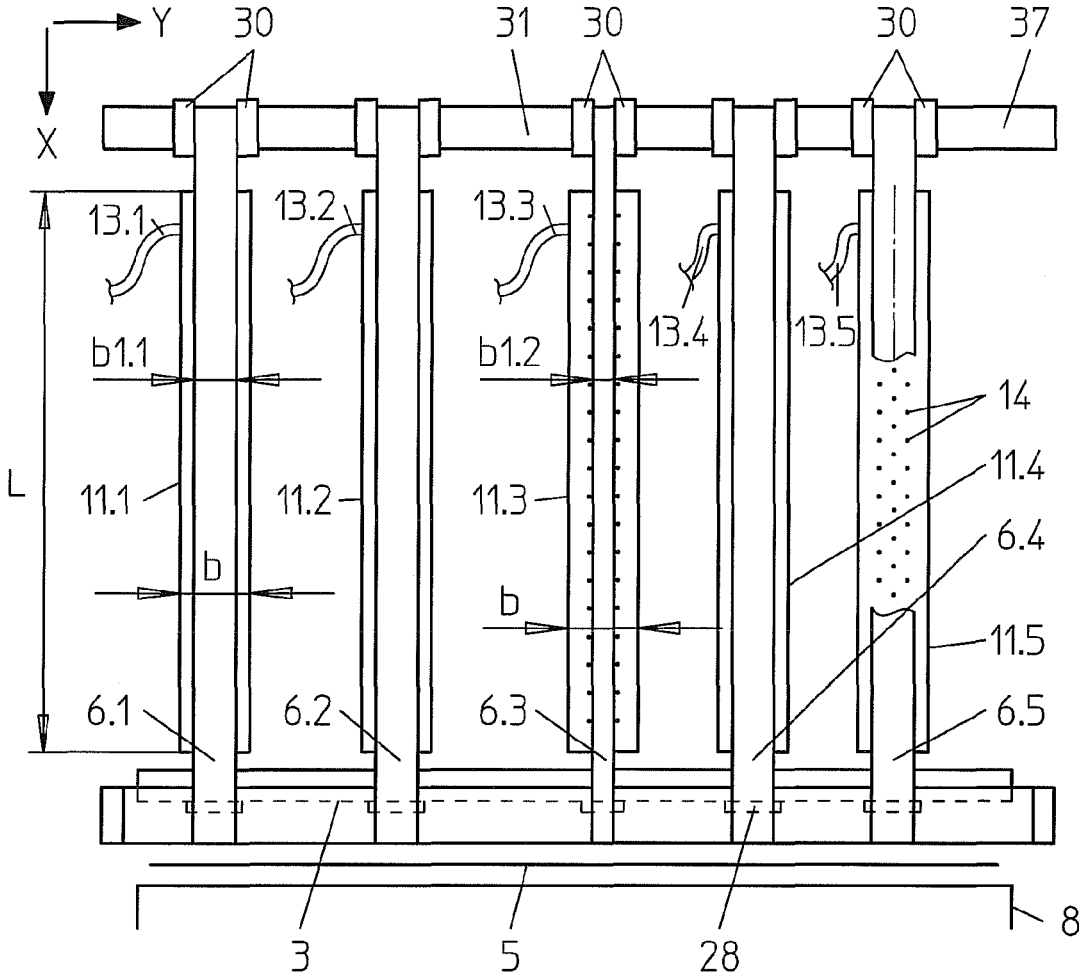
Figure 4:
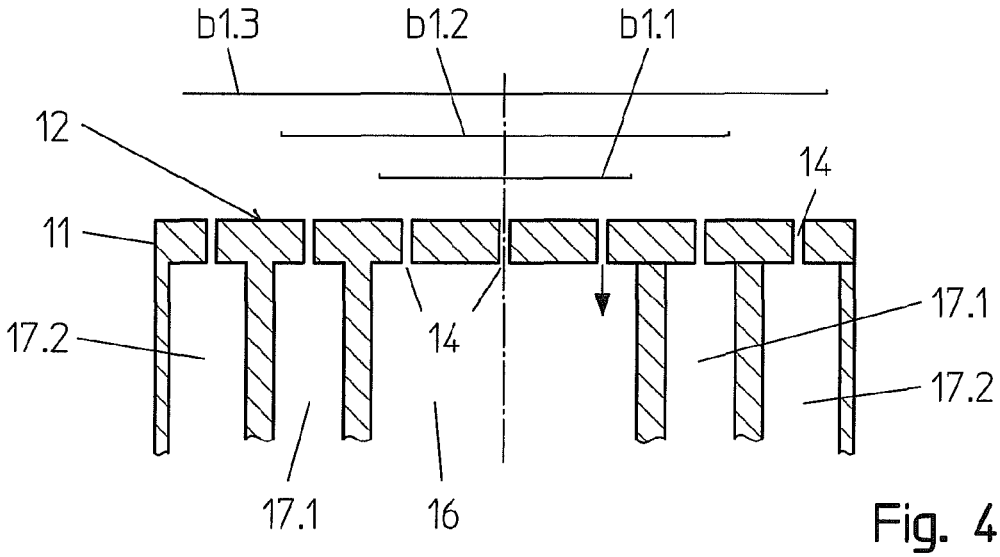
Figure 5:
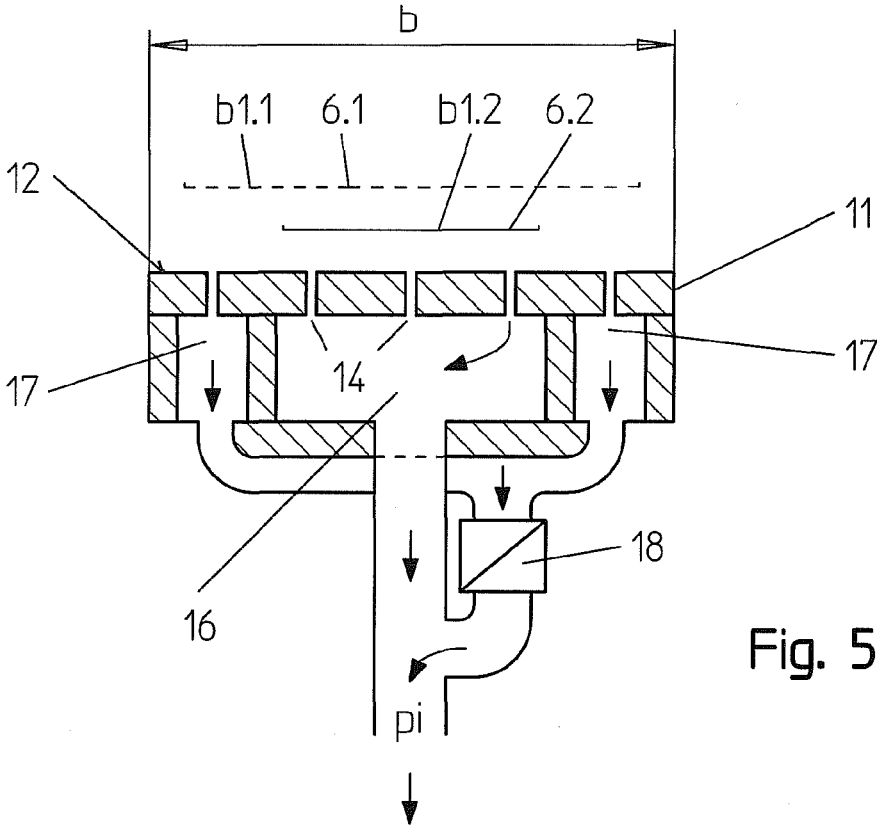
Figure 6:
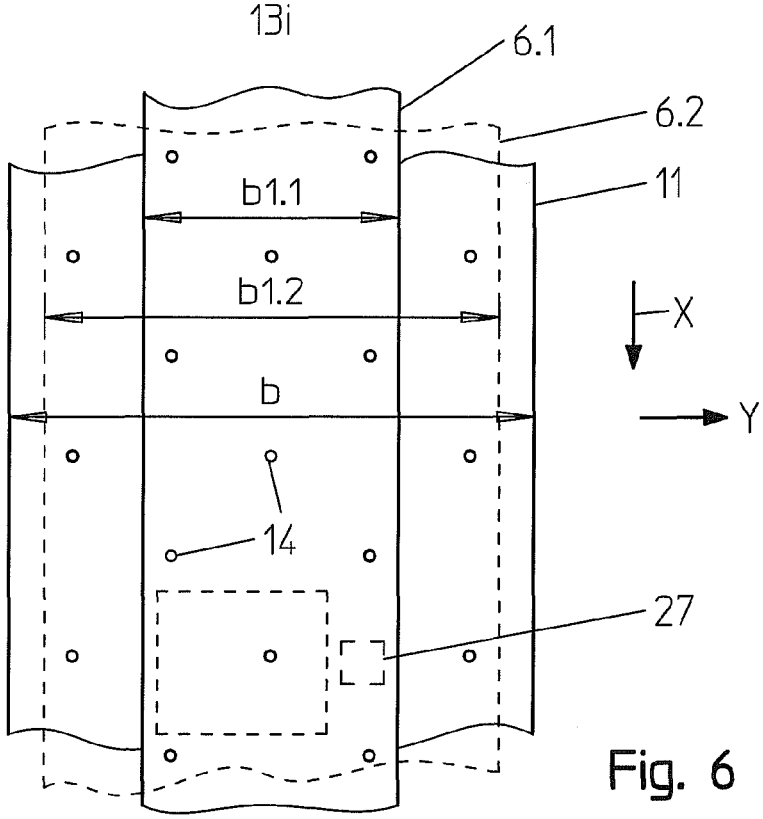
Figure 7:
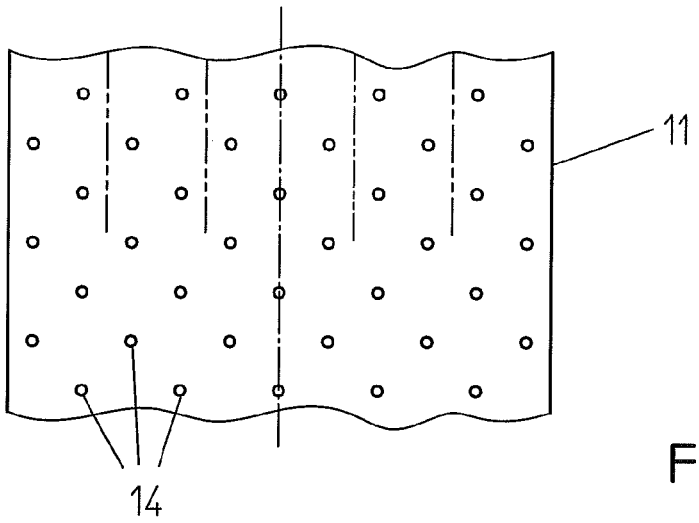
FIG. 7 shows a further example with a symmetrical arrangement of suction openings 14, which can be divided into various zones, in analogy to FIG. 4.
Figure 8:
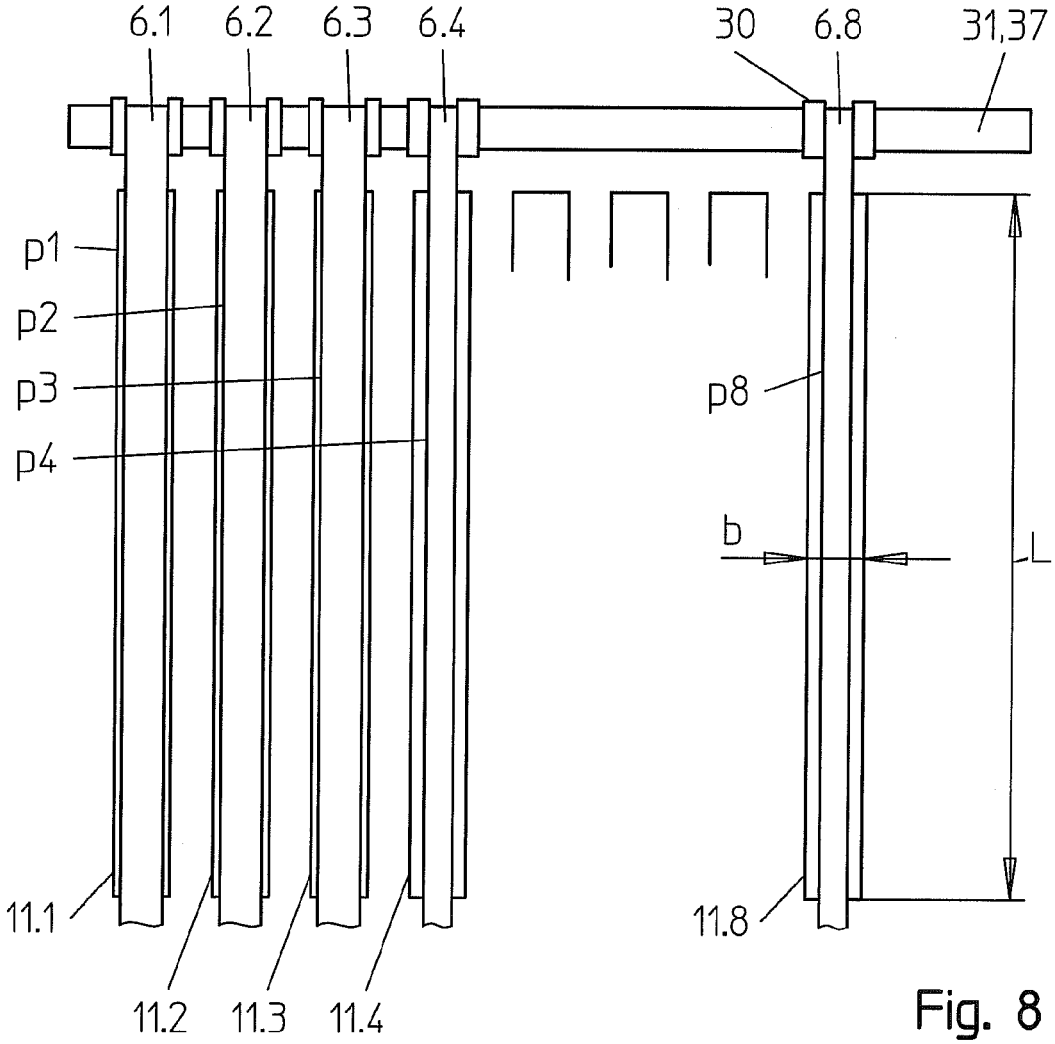
FIG. 8 depicts an example with eight narrow web guides 11.1-11.8 with negative pressures p1-p8 for eight picture foil webs 6.1-6.8 for correspondingly high picture embossing capacities.

A braking- and guiding wall of this kind is depicted in FIG. 2 and is also known from EP 1 593 503. This, however, is not suitable for several picture foil webs, because their tensile stresses zi with the machine running are not capable of being individually controlled and adjusted.

Figure 10A:
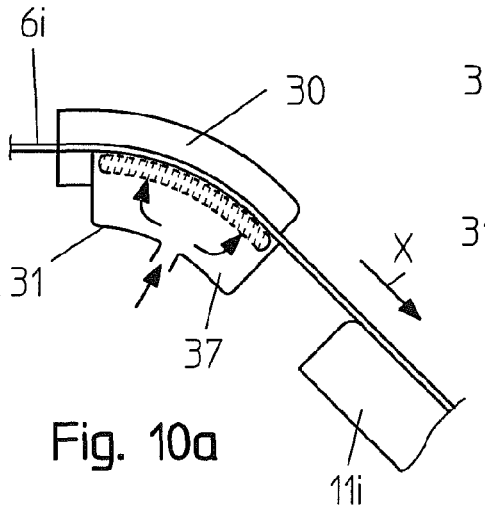
Figure 10B:
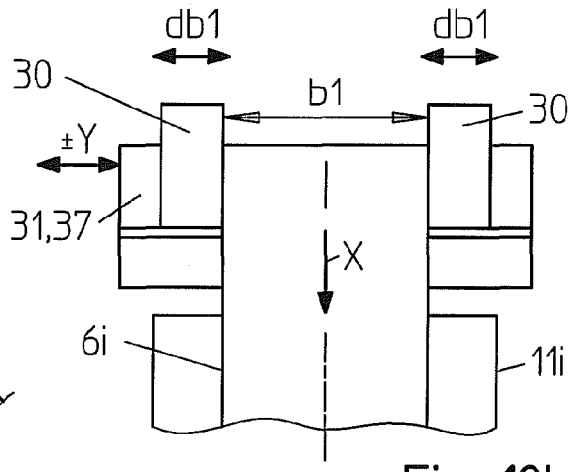
Figure 11:
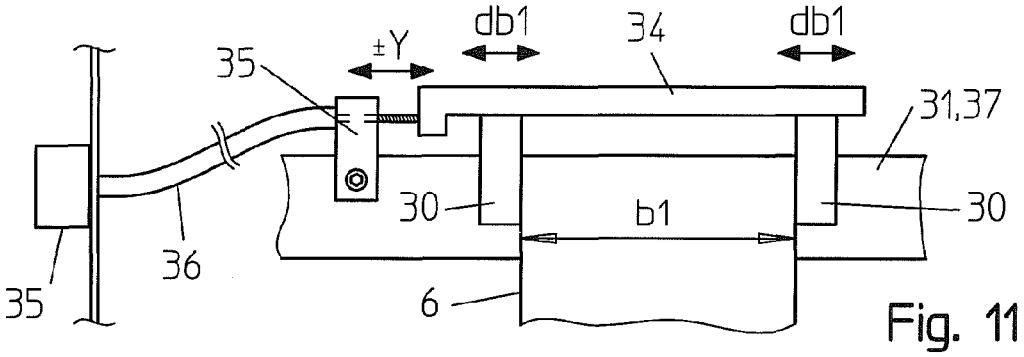

The FIGS. 10 and 11 illustrate examples of lateral guiding elements 30 on both sides adjustable in transverse direction Y on low-friction deflecting elements 31, 32, with which the picture foil webs 6*i* in Y-direction are able to be accurately adjusted to the optimum picture mark positions. In case of fixed deflecting elements, it must be possible for the foil webs to be very easily displaced in Y-direction on the deflecting elements, as free of friction as possible. For this purpose, the deflecting elements 31, 32 can be designed as air cushion supporting surfaces 37 and, e.g., consist of a micro-porous layer permeable to air, which is aerated.

The FIGS. 10*a, b* in a side- and front view illustrate an example of a practically friction-free deflecting element 31, which is designed as a bent air cushion supporting surface 37. First the web guide 11*i* with the machine at standstill is correctly positioned and the distance of the lateral guiding elements 30 on both sides, which here are fixed on the deflecting element as displaceable (db1), is adjusted to the foil web width b1. Thereafter the two lateral guiding elements 30 together with the deflecting element (with the machine running) are able to be adjusted in Y-direction to the optimum picture mark position (±Y).

FIG. 11 illustrates a further example, in which the two lateral guiding elements 30 are fixed to a connection element 34 an are adjustable (db1) to the foil width b1. They are thus both together displaceable and adjustable in transverse direction Y. This adjustment (±Y), e.g., can be transmitted to an operating panel through a flexible shaft 36 and carried out with a setting device 35 either manually or by means of a servo-motor (actuator).

After the drawing (advancing) of the foil webs 6*i* into the next embossing position and the standstill of the foil webs for the embossing step, it is easily possible that there is a slight sliding-on. In order to prevent this, the foil webs shortly before the standstill can be pressed onto the web guides 11*i* more strongly with an increased negative pressure pi and with this a sliding-on of the foil webs in standstill can be prevented.

Figure 12:
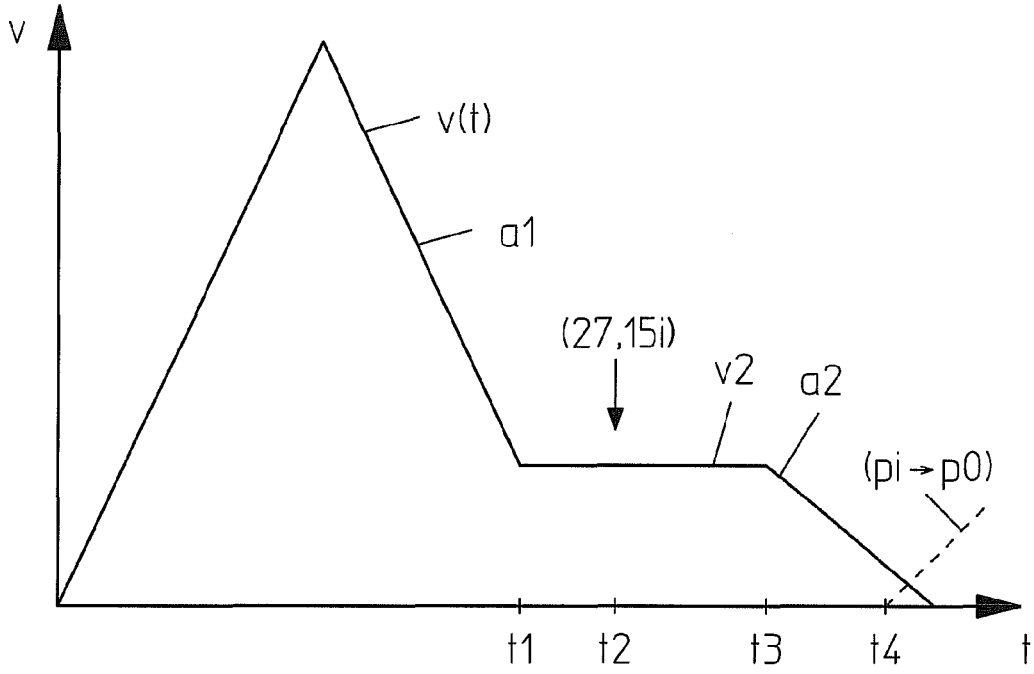

For illustrating this, FIG. 12 schematically depicts the course over time v(t) of the foil web speed, when it is drawn to the next embossing position: First there is a rapid drawing with a high acceleration and subsequent deceleration a1 (of, e.g., 10-30 m/s$^2$) until shortly before the picture mark (time t1). Then with a reduced speed v2 (of, e.g., 5 cm/s) there follows the detection of the picture mark (27) by the picture mark sensors 15*i* at the time t2. As from the time t3 the picture foil webs 6*i* are braked with a very much lower deceleration a2 (e.g., 2 m/s$^2$) and shortly before the standstill (at the time t4) the negative pressure pi in the web guides 11*i* is rapidly increased and with this the foil webs 6*i* are pressed against the web guides more strongly, so that a sliding-on in standstill is prevented.

Figure 13:
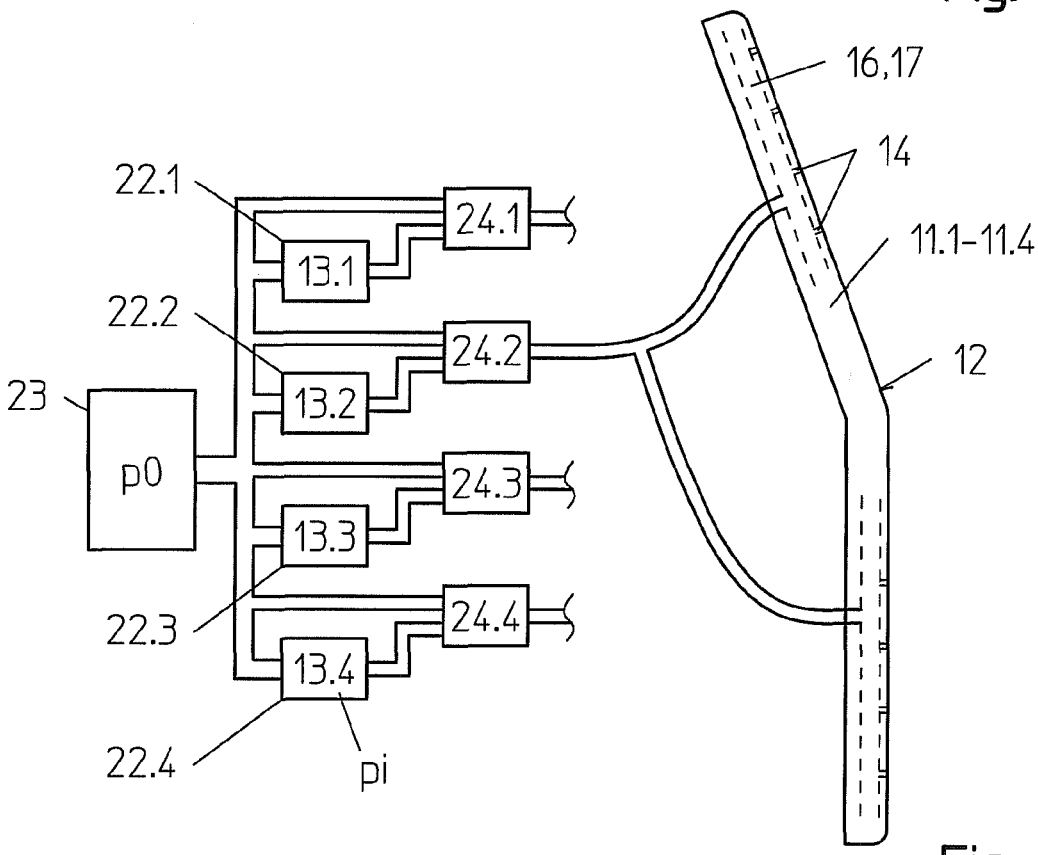

FIG. 13 shows an example for producing this rapid increase of the negative pressure pi by means of additional fast switching vacuum switching valves 24.1-24.4, which are connected with negative pressure sources 13.1-13.4, with the central suction fan 23 and with the web guides 11.1-11.4. At the time t4 (FIG. 12), shortly before the standstill of the foil webs 6*i*, the vacuum switching valves 24*i* are rapidly opened (in msec) and the increased negative pressure p0 of the central suction fan 23 is conducted directly to the web guides 11*i*. After the embossing process has taken place, a changeover to the reduced controlled negative pressure pi of the individual negative pressure sources 13.1-13.4 is effected.

Within the framework of this description the following designations are utilised:

1 Flat bed embossing machine, -foil stamping machine
2 Foil web guiding device
3 Tool plate
4 Flat bed press
5 Flat material
5.1 Sheets
5.2 Continuous web
6.1, 6.2 Picture foil webs
6.11, 6.12 Dye foil webs
6, 6*i* Foil webs, embossing foil webs
6*a* Image layer side of 6
7, 7*i* Unwinding rolls
8 Embossing table, embossing position
9*i* Foil drawing devices, foil feeding devices
10 Braking- and guiding wall
11, 11*i* Web guides for 6
12 Surfaces of 11
13, 13*i* Negative pressure sources for 11
14 Suction openings in 12
15, 15*i* Print mark sensors, picture mark sensors
16 Central suction channel in 11
17 Lateral suction channels
18 Leakage air control valve
20 Vacuum loop stores, foil stores
22*i* Vacuum controller
23 Central suction fan
24*i* Vacuum switching valves
27 Print marks, picture marks on 6
28 Dies, printing plates
29 Foil removal device
30 Lateral guiding elements
31, 32 Low-friction deflecting elements, supporting surfaces
34 Settable connection of 30
35 Setting device for 30
36 Flexible shaft
37 Air cushion supporting surface, air cushion axes
40*i* Foil web tension sensors
71 Feeder
72 Delivery means
L Length of 11
b Width of 11
b1 Width of foil web
db1 Setting of b1
ee Foil strains at 8, elongation
za, zai Tensile stresses ahead of 11 zf, zfi Braking forces, tensile stresses of 11 z, zi Tensile stresses, tensile stresses at the embossing position 8, z=za+zf p, pi Negative pressure in 11 p0 Negative pressure in 23 v Foil web speed a Acceleration t Time

X Drawing direction of 6

Y Transverse direction

The invention claimed is:

1. Flat bed embossing machine with a foil web guiding device (2) for several foil webs (6), which from unwinding rolls (7) are conducted over a tool plate (3) on a flat bed press (4), with a foil tensioning device ahead of the tool plate and with foil drawing devices (9) for every foil web after the tool plate, characterised in that directly ahead of the tool plate (3) several individually adjustable in transverse direction (Y) to the drawing direction (X), long, central symmetrically configured web guides (11.1, 11.2, 11.3) are provided as foil tensioning devices, with a smooth, low-friction surface (12)

and with suction openings (14) in the surfaces, which are connected with controllable negative pressure sources (13.1, 13.2, 13.3) for the independent setting of negative pressure (pi) and braking force (zi) on every individual web guide (11.1, 11.2, 11.3), wherein to every picture foil web (6*i*) a print mark sensor (15*i*) is assigned between the foil drawing device (9*i*) and the web guide (11*i*)

and lateral guiding elements (30) settable on both sides on low-friction deflecting elements (31, 32) directly ahead of the web guides and behind the tool plate (3) are assigned, wherein said lateral guiding elements (30) can guide the foil webs (6*i*) centered on the web guides.

2. Flat bed embossing machine according to claim 1, characterised in that the surface (12) of the web guides comprise fluoride polymer plastic material or consists of hard anodised aluminium with embedded fluoride polymer.

3. Flat bed embossing machine according to claim 1, characterised in that the surfaces (12) of the web guides comprise a minimum electrical conductivity, so that no electro-static charging of the foil webs can take place.

4. Flat bed embossing machine according to claim 1, characterised in that the difference between the static friction—and the sliding friction coefficient of the foil webs on the surface (12) of the web guides amounts to a maximum of 10-20%.

5. Flat bed embossing machine according to claim 1, characterised in that the length L of the web guides (11) amounts to between 50 and 100 cm.

6. Flat bed embossing machine according to claim 1, characterised in that the ratio of length to width L/b of the web guides is situated within a range of between 5 and 15.

7. Flat bed embossing machine according to claim 1, characterised in that the suction openings (14) comprise a diameter of 1-3 mm and/or a surface proportion of the suction openings of 0.5-3%.

8. Flat bed embossing machine according to claim 1, characterised in that the print mark sensors (15*i*) are arranged on the foil drawing devices (9*i*), in the centre of the tool plate (3) or at the end of the web guides (11*i*).

9. Flat bed embossing machine according to claim 1, characterised in that the deflecting elements (31, 32) ahead of the web guides and after the tool plate are designed as air cushion supporting surfaces (37).

10. Flat bed embossing machine according to claim 1, characterised in that the suction channels (16, 17) in the web guides (11) form a central zone and symmetrical edge zones.

11. Flat bed embossing machine according to claim 10, characterised in that the web guides comprise a central suction channel (16) and two adjoining lateral suction channels (17) connected together, which through a leakage air control valve (18) are connected with the negative pressure sources (13*i*).

12. Flat bed embossing machine according to claim 1, characterised in that over the whole length of the foil web guiding from the unwinding rolls (7) up to the tool plate (3) there are no guiding elements on the image layer side (6*a*) of the foil webs.

13. Flat bed embossing machine according to claim 1, characterised by a vacuum loop store (20) ahead of the web guides (11).

14. Flat bed embossing machine according to claim 1, characterised in that the lateral guiding elements (30) are connected together, that their spacing is adjustable to the width of the foil web foil (b1) and that they are adjustable together in transverse direction (Y).

15. Flat bed embossing machine according to claim 1, characterised in that the controllable negative pressure sources (13*i*) are designed as controllable vacuum controllers (22*i*), which are connected with a central suction fan (23).

16. Flat bed embossing machine according to claim 15, characterised in that every controllable negative pressure source (13*i*) is connected with a rapid switching vacuum valve (24*i*), which also comprises a connection to the central suction fan (23).

17. Flat bed embossing machine according to claim 1, characterised by a controlling of the foil drawing, with which the picture foil webs (6*i*) after the detection of the print marks (27) by the print mark sensors (15*i*) are slowly braked and wherein shortly before the standstill of the picture foil webs the negative pressure (pi) in the web guides (11*i*) is rapidly increased.

18. Flat bed embossing machine according to claim 1, characterised in that after the web guides (11*i*) foil web tension sensors (40*i*) are arranged for determining the foil tensions and wherein the control of the negative pressure sources (13*i* can be executed as a controlling to a settable desired value of the foil tension (zi) or of the foil strain (ee).

19. Flat bed embossing machine according to claim 1, characterised in that under the web guides (11*i*) additionally a short and wide braking—and guiding wall (10) is arranged as foil tensioning device for the simultaneous embossing with several picture foil webs (6.1, 6.2) and with dye foil webs (6.11, 6.12).

* * * * *

UNITED STATES PATENT AND TRADEMARK OFFICE

CERTIFICATE OF CORRECTION

PATENT NO. : 8,459,323 B2
APPLICATION NO. : 12/991682
DATED : June 11, 2013
INVENTOR(S) : Marc Günther Brendle It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 297 days.

Signed and Sealed this
Eighth Day of September, 2015

Michelle K. Lee

Michelle K. Lee
*Director of the United States Patent and Trademark Office*